US009879671B1

(12) United States Patent
Taylor et al.

(10) Patent No.: US 9,879,671 B1
(45) **Date of Patent: *Jan. 30, 2018**

(54) HYDRAULIC MOTOR ASSEMBLY

(71) Applicant: Hydro-Gear Limited Partnership, Sullivan, IL (US)

(72) Inventors: Michael W. Taylor, Breese, IL (US); Heath F. McCormick, Shumway, IL (US); Nathan W. Bonny, Shelbyville, IL (US); Thomas J. Langenfeld, Sullivan, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 305 days.

This patent is subject to a terminal disclaimer.

(21) Appl. No.: 14/703,518

(22) Filed: May 4, 2015

Related U.S. Application Data

(63) Continuation of application No. 13/115,343, filed on May 25, 2011, now Pat. No. 9,021,799.

(60) Provisional application No. 61/426,225, filed on Dec. 22, 2010, provisional application No. 61/348,607, filed on May 26, 2010.

(51) Int. Cl.
*F04C 2/30* (2006.01)
*F04C 14/24* (2006.01)

(52) U.S. Cl.
CPC ..... *F04C 14/24* (2013.01); *F04C 2/30* (2013.01)

(58) Field of Classification Search
CPC ..... F16H 39/10; F16H 61/47; F16H 39/02; F04C 14/24; F04C 2/30; F03C 1/0431
See application file for complete search history.

(56) References Cited

U.S. PATENT DOCUMENTS

| | | | | |
|---|---|---|---|---|
| 2,470,220 | A | 5/1949 | Mott | |
| 3,575,521 | A | 4/1971 | Robert et al. | |
| 4,122,974 | A | 10/1978 | Harbert et al. | |
| 4,314,515 | A | 2/1982 | Jimenez et al. | |
| 5,927,073 | A * | 7/1999 | Ishizaki | F04B 1/22 60/487 |
| 6,003,455 | A | 12/1999 | Flamme et al. | |
| 6,343,471 | B1 * | 2/2002 | Thoma | B60K 17/105 60/487 |
| 6,561,024 | B2 | 5/2003 | Bell | |
| 6,880,686 | B1 | 4/2005 | Hauser et al. | |
| 6,884,195 | B2 | 4/2005 | Thomas et al. | |

(Continued)

FOREIGN PATENT DOCUMENTS

DE 3406783 A1 8/1984

*Primary Examiner* — Nathaniel Wiehe
*Assistant Examiner* — Abiy Teka
(74) *Attorney, Agent, or Firm* — Neal, Gerber & Eisenberg LLP

(57) ABSTRACT

A hydraulic motor assembly capable of precise control having a housing, a hydraulic mounting surface located in the housing, a cylinder block rotatably disposed on the hydraulic mounting surface, a motor shaft engaged to the cylinder block and supported proximate to a first end, a plurality of cooperating gears located in the housing and rotationally engaged to a second end of the motor shaft, an output shaft rotationally engaged to the plurality of cooperating gears, a speed sensor located proximate to one of the plurality of cooperating gears, wherein the speed sensor transmits a signal indicative of the rotational speed of the one of the plurality of cooperating gears.

22 Claims, 8 Drawing Sheets

(56) References Cited

U.S. PATENT DOCUMENTS

| | | | | |
|---|---|---|---|---|
| 6,886,315 | B1 | 5/2005 | Hauser et al. | |
| 6,951,093 | B1 | 10/2005 | Hauser et al. | |
| 7,017,326 | B1 | 3/2006 | Keller et al. | |
| 7,032,377 | B1 | 4/2006 | Keller et al. | |
| 7,185,596 | B2 | 3/2007 | Thiemke et al. | |
| 7,242,180 | B1 * | 7/2007 | O'Connor | G01P 1/026 324/207.2 |
| 7,266,938 | B1 | 9/2007 | Hauser et al. | |
| 7,313,914 | B1 | 1/2008 | Reid et al. | |
| 7,473,207 | B1 | 1/2009 | Hauser et al. | |
| 7,503,174 | B1 | 3/2009 | Reid et al. | |
| 7,617,785 | B2 | 11/2009 | Wendte | |
| 7,735,438 | B2 | 6/2010 | Riewerts | |
| 7,908,850 | B1 | 3/2011 | Reid et al. | |
| 9,021,799 | B1 * | 5/2015 | Taylor | F15B 9/08 60/487 |

* cited by examiner

HYDRAULIC MOTOR ASSEMBLY

CROSS REFERENCE

This application is a continuation of U.S. patent application Ser. No. 13/115,343 filed on May 25, 2011, which claims the benefit of U.S. Provisional Patent Application Ser. No. 61/348,607 filed on May 26, 2010 and U.S. Provisional Patent Application Ser. No. 61/426,225 filed on Dec. 22, 2010. The contents of these applications are incorporated herein by reference in their entirety.

BACKGROUND OF THE INVENTION

This application relates to motor assemblies generally and, in particular, to hydraulic motor assemblies intended for use in driving a vehicle or other apparatus, such as a seed planting mechanism, a powered implement or a walk-behind machine such as a mower or snow thrower, for example.

SUMMARY OF THE INVENTION

An improved hydraulic motor assembly is disclosed herein. One or more hydraulic motor assemblies can be mounted on a vehicle or other powered equipment to drive, for example, one or more wheels, implements or shafts. A speed sensor can be incorporated in the hydraulic motor assembly to provide operational feedback to an electronic controller that precisely regulates the motor assembly's output via direct control of a hydraulic pump in fluid communication with the hydraulic motor assembly.

A hydraulic motor assembly generally requires a case drain to remove the volume of fluid losses from the hydraulic motor that accumulate in the motor chamber. To eliminate the need for additional structure, such as additional hydraulic line and case drain port, an internal case drain may be provided. This can be a particular advantage when the hydraulic motor assembly is distant from its corresponding pump as in the case of an agricultural seed planter.

A better understanding of the objects, advantages, features, properties and relationships of the invention will be obtained from the following detailed description and accompanying drawings which set forth illustrative embodiments that are indicative of the various ways in which the principles of the invention may be employed.

DETAILED DESCRIPTION OF THE DRAWINGS

Figure 1:
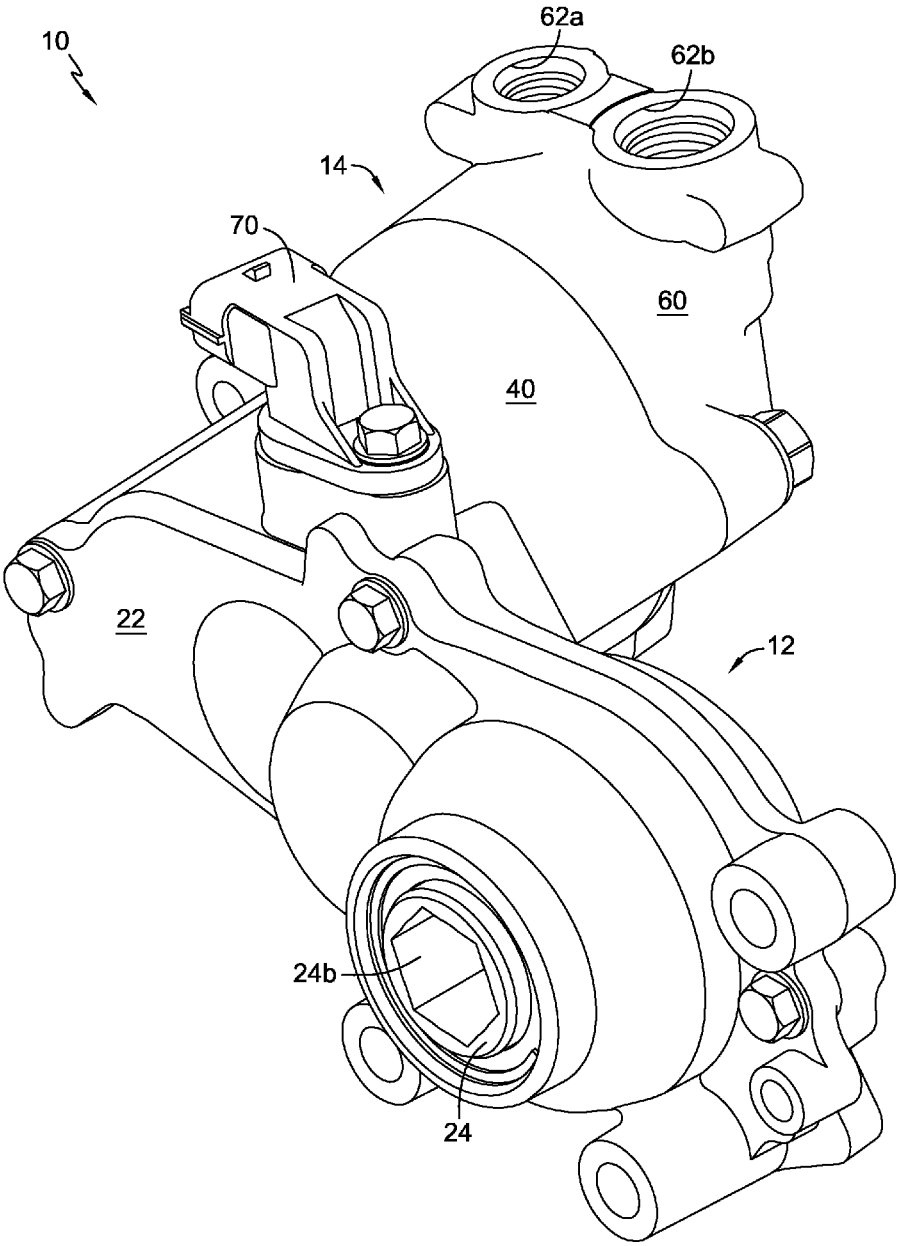
FIG. 1 is a perspective view of a first embodiment of a hydraulic motor assembly with speed sensor in accordance with the principles of the invention.

The description that follows describes, illustrates and exemplifies one or more embodiments of the present invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. As stated above, the present specification is intended to be taken as a whole and interpreted in accordance with the principles of the present invention as taught herein and understood by one of ordinary skill in the art.

Figure 2:
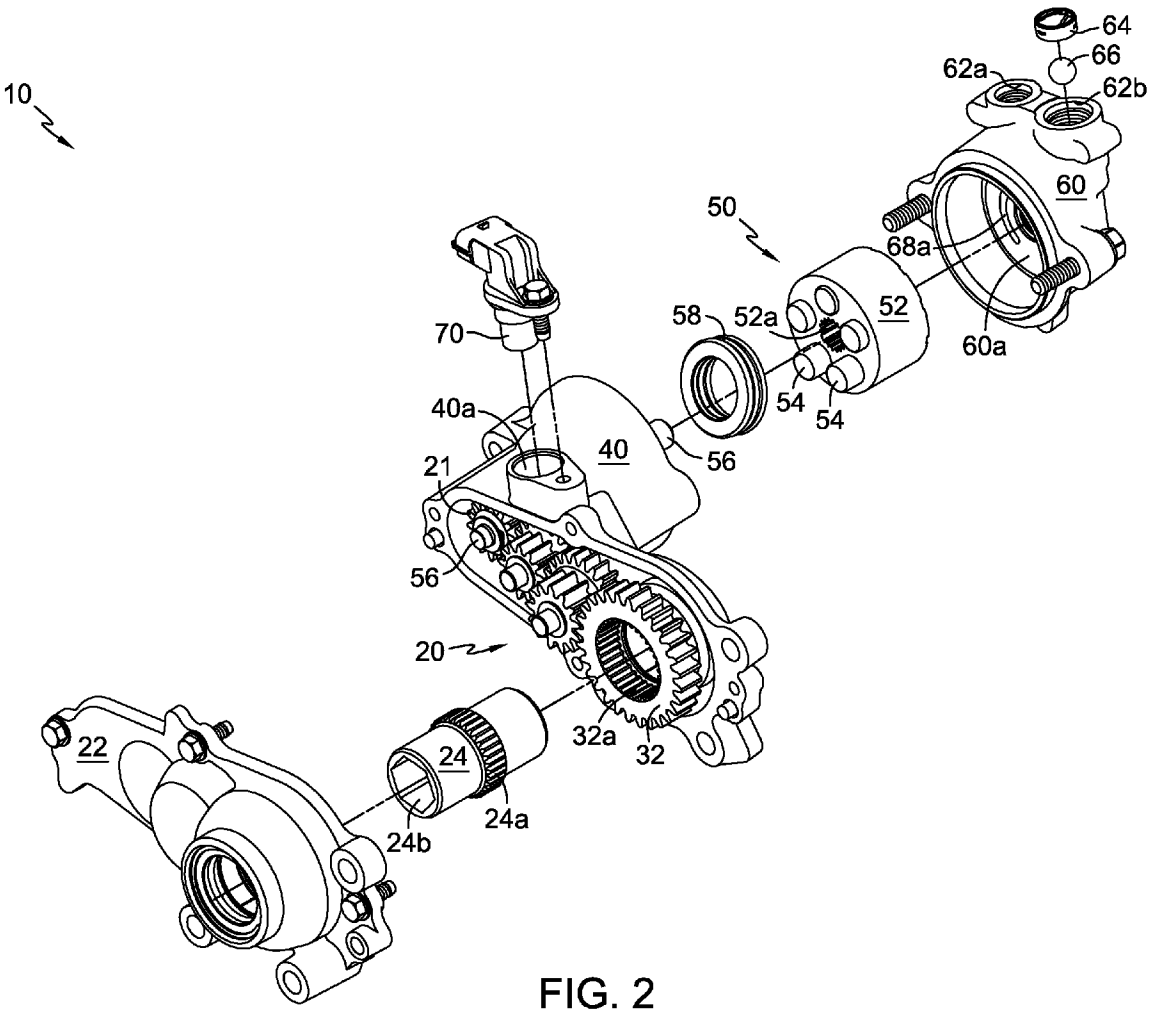
FIG. 2 is a partially exploded perspective view of the hydraulic motor assembly with speed sensor of FIG. 1.
Figure 3:
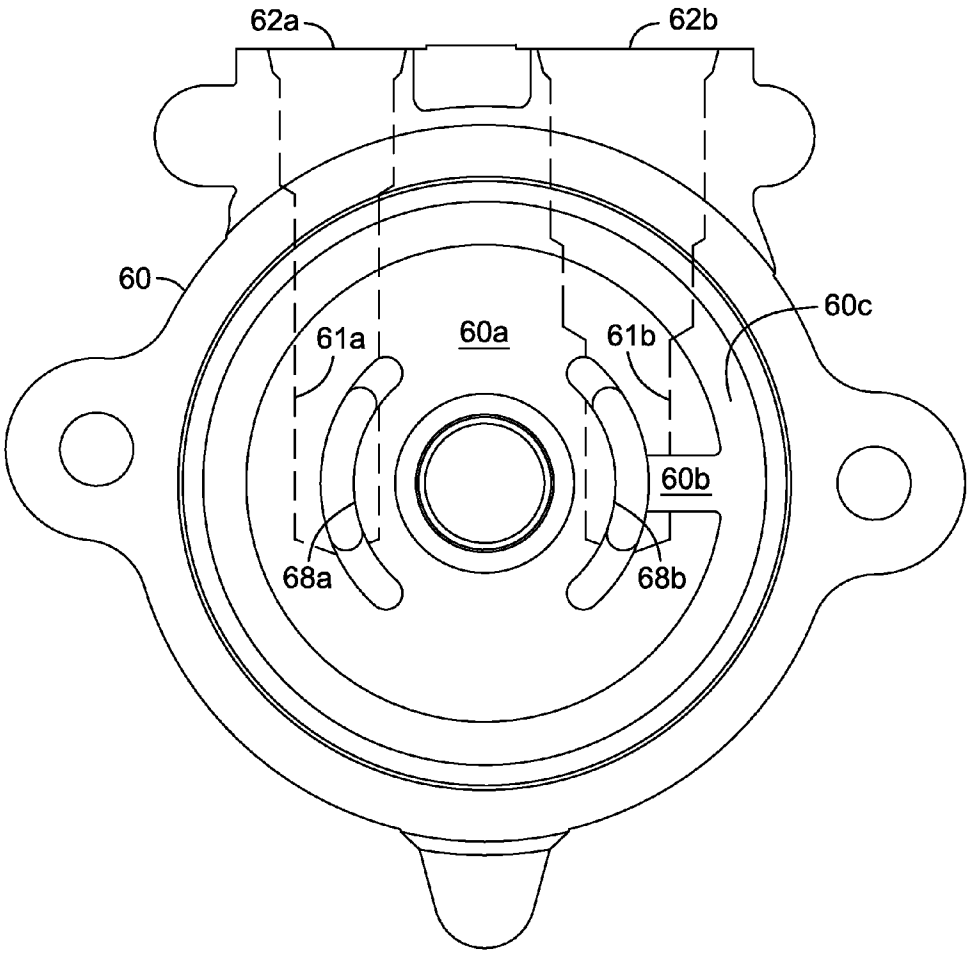
FIG. 3 is an elevational view of a motor housing of the hydraulic motor assembly with speed sensor of FIG. 1.
Figure 4:
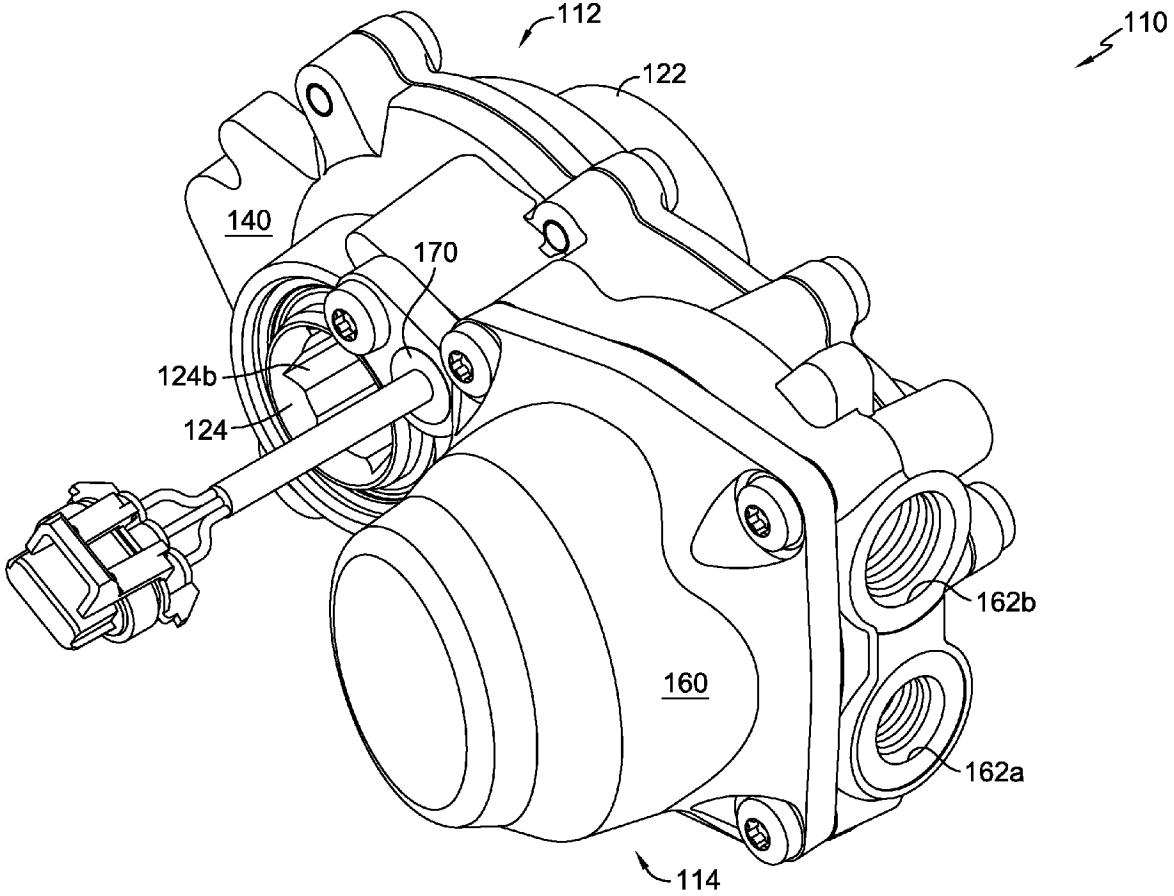
FIG. 4 is a perspective view of a second embodiment of a hydraulic motor assembly with speed sensor in accordance with the principles of the invention.

Referring to FIGS. 1-3, a first embodiment of a hydraulic motor assembly 10 of the present invention includes a gear assembly 20 housed within a first volume or sump, namely gear chamber 12 that is formed by joining gear housing 22 and main housing 40. Hydraulic motor assembly 10 also includes a motor 50 housed within a second volume or sump, namely motor chamber 14 that is formed by joining motor housing 60 and main housing 40. These two volumes can be hydraulically separate or in fluid communication with one another. In the illustrated first embodiment of hydraulic motor assembly 10, there is no fluid passage formed in main housing 40 to connect the first volume (gear chamber 12) to the second volume (motor chamber 14). In this instance, motor chamber 14 is sealed off from gear chamber 12 by a pressure seal (not shown) through which motor shaft 56 passes from one chamber to the next. A result of separating gear chamber 12 from motor chamber 14 is less wear on motor running surface 60*a* due to reduced contamination of the hydraulic fluid driving motor 50. A fluid passage between gear chamber 12 and motor chamber 14 can be added, if desired, and fluid can be filtered in a known manner, if deemed necessary or desirable for a particular hydraulic system configuration.

A gear assembly 20, depicted herein as a three-stage reduction assembly comprising a pinion gear, two combination gears, and a spur gear concentric with and engaged to an output shaft, can consist of one or more reduction stages depending on the particular vehicle or apparatus application. The various gears and shafts depicted herein can be supported in the housings in various ways known in the art. The gear assembly 20 initiates with pinion gear 21, which is driven by an end of motor shaft 56. Gear assembly 20 terminates with concentric drive gear 32 for driving output shaft 24 via the mating of splines 32*a* and 24*a*. Output shaft 24 is depicted as a tubular, hex cross-sectioned, output shaft and is configured as a through-shaft in hydraulic motor assembly 10, being accessible at each end through corresponding openings in gear housing 22 and main housing 40.

Output shaft 24 includes hex mating surface 24*b* which is shaped to engage a correspondingly shaped shaft or axle (not shown). Gear assembly 20, as configured, serves to reduce the output speed of, and increase the torque to, output shaft 24.

Figure 8:
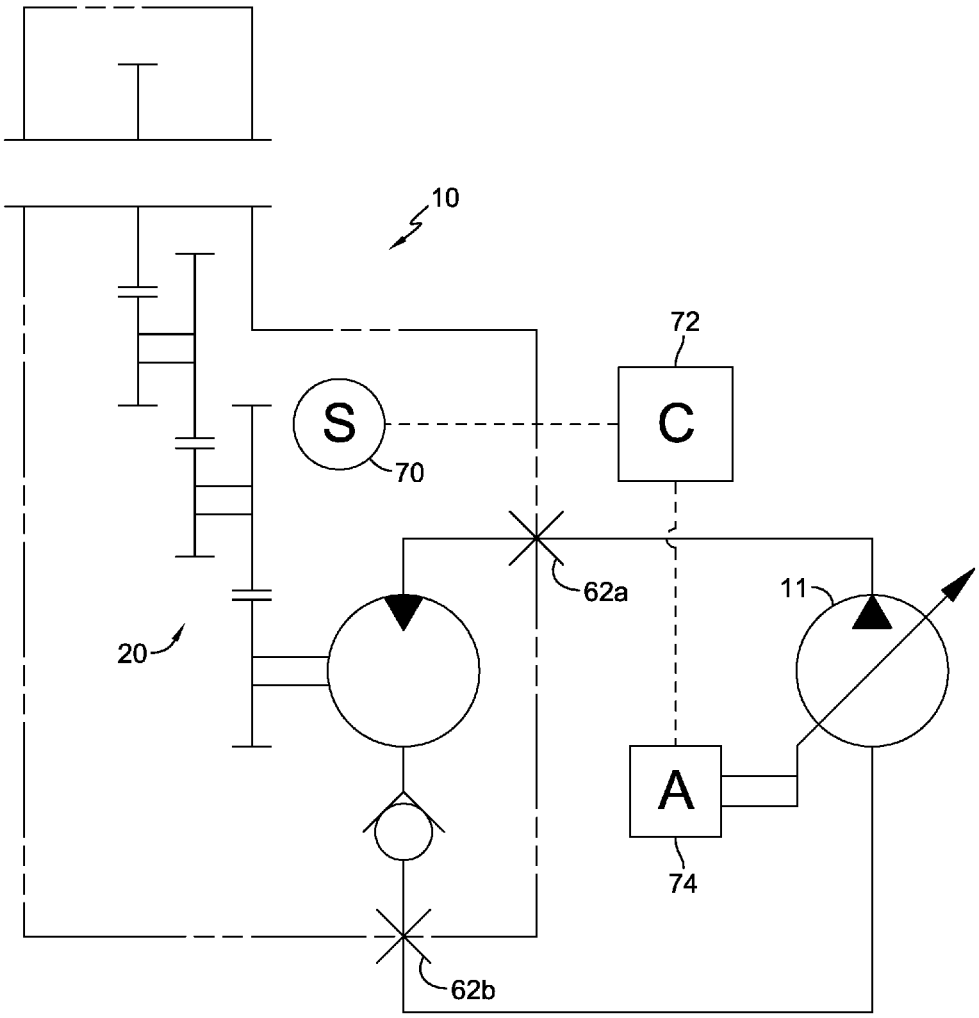
FIG. 8 is a schematic diagram of a hydraulic circuit with electronic control incorporating the first embodiment.

Rotational drive is provided to gear assembly 20 by means of a hydraulic motor 50, depicted herein as comprising axial piston cylinder block 52 disposed on the running surface 60*a*, also known as a hydraulic mounting surface, that is formed on motor housing 60. It will be understood that a valve plate could optionally be used if necessary between cylinder block 52 and running surface 60*a*. Motor housing 60 includes hydraulic passages 61*a* and 61*b* formed therein to provide fluid communication between the kidney ports 68*a* and 68*b*, respectively, of running surface 60*a* and hydraulic ports 62*a* and 62*b*, respectively, on the exterior of motor housing 60. As shown in FIG. 8, hydraulic ports 62*a* and 62*b* in turn provide fluid communication with additional elements of a hydraulic circuit, namely pump 11. Motor shaft 56, supported partially by motor housing 60 and partially by main housing 40, includes splines (not shown) that are mated with splines 52*a* of cylinder block 52. Cylinder block 52 is rotated by hydraulic fluid flow provided through a hydraulic circuit by a pump, such as pump 11 in FIG. 8, to drive motor shaft 56. Cylinder block 52 receives pistons 54 that ride on thrust bearing 58 and communicate with kidney ports 68*a* and 68*b* that are formed on running surface 60*a*.

As shown in FIG. 3, an internal case drain may be provided in the form of a slot 60*b* that connects an annular groove 60*c* formed about running surface 60*a* to kidney port 68*b*, and consequently, to hydraulic passage 61*b* and hydraulic port 62*b*. Thus, slot 60*b* places motor chamber 14 in fluid communication with kidney port 68*b*. As configured, hydraulic port 62*b* is necessarily serving as the discharge port of hydraulic motor assembly 10, while hydraulic port 62*a* serves as the inlet port. Thus, any fluid build-up in motor chamber 14 is evacuated through hydraulic port 62*b*.

To prevent damage to any housing or shaft seals from high pressure hydraulic fluid moving through the internal case drain, as in the instance of an operator inadvertently reversing the hydraulic lines to hydraulic ports 62*a* and 62*b*, an optional check valve, in this case check ball retainer 64 and check ball 66, can be installed in hydraulic discharge port 62*b*. Thus, unidirectional fluid flow in the hydraulic motor assembly 10 is established. If bidirectional motor operation is desired, an external case drain (not shown) can be provided and the check ball retainer 64 and check ball 66 can be eliminated. To balance the flow of hydraulic fluid into hydraulic port 62*a* and out of hydraulic port 62*b* when check ball retainer 64 and check ball 66 are present, the inside diameter of hydraulic port 62*b* is enlarged relative to that of hydraulic port 62*a*. The specific sizes can be determined based on the application.

Speed sensor 70 (e.g., a Hall effect sensor) fits into an external port 40*a* formed in main housing 40, and passes therethrough to the gear chamber 12 to sense the speed of one of the gears of gear assembly 20. As illustrated in FIG. 8, speed sensor 70 is preferably connected to an electronic controller 72 for the hydraulic circuit that regulates the flow of hydraulic fluid from the corresponding pump 11 by means of, e.g., an electro-mechanical actuator 74, thus permitting precise control of the output of hydraulic motor assembly 10 based, at least in part, on feedback from the speed sensor 70, a signal corresponding to the rotational speed of an element of gear assembly 20. Additional operational inputs and sensor feedback from other components of a vehicle or powered implement (not shown) could be evaluated by the electronic controller in determining the output of hydraulic motor assembly 10.

Figure 5:
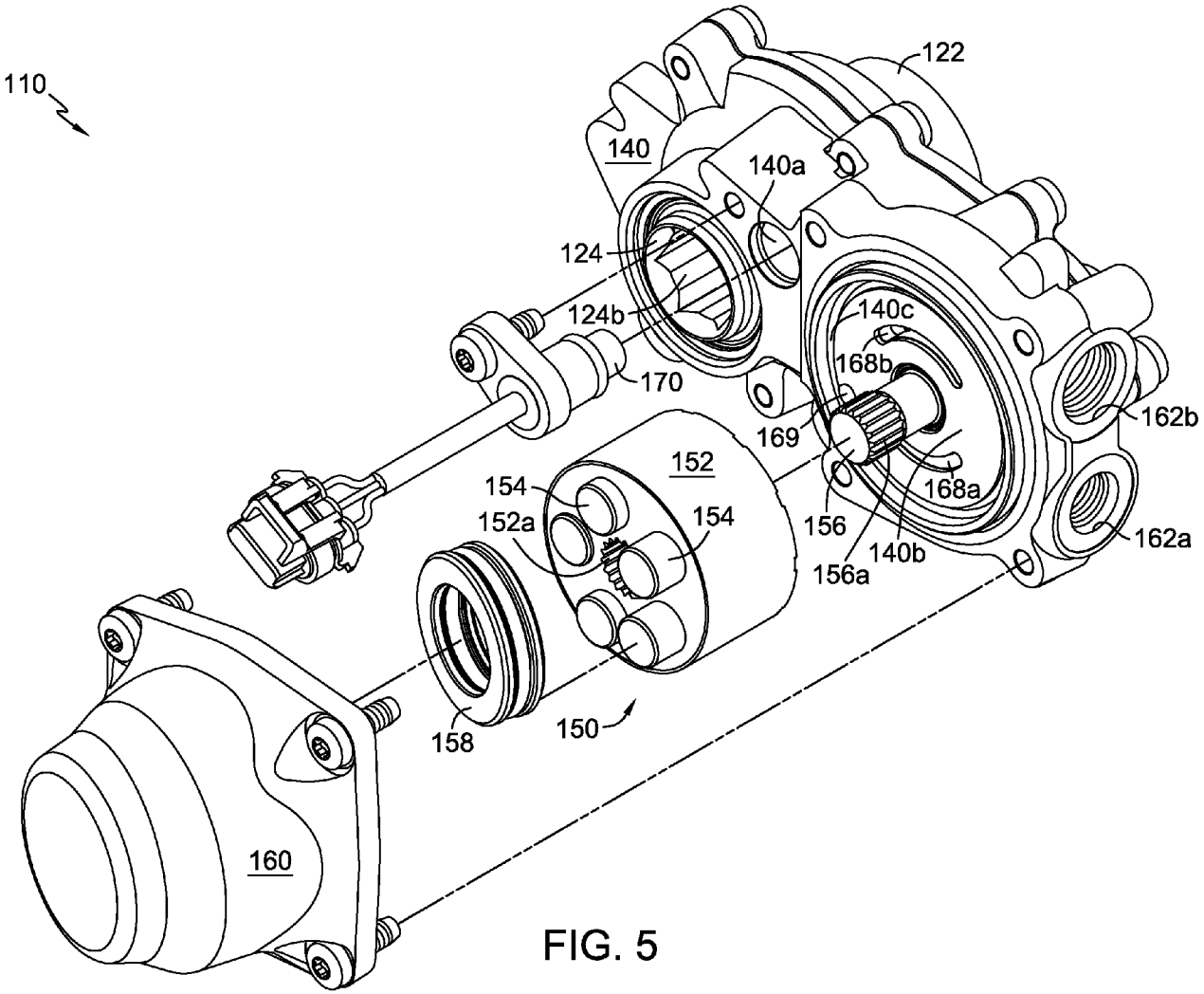
FIG. 5 is a partially exploded perspective view of the hydraulic motor assembly with speed sensor of FIG. 4.
Figure 6:
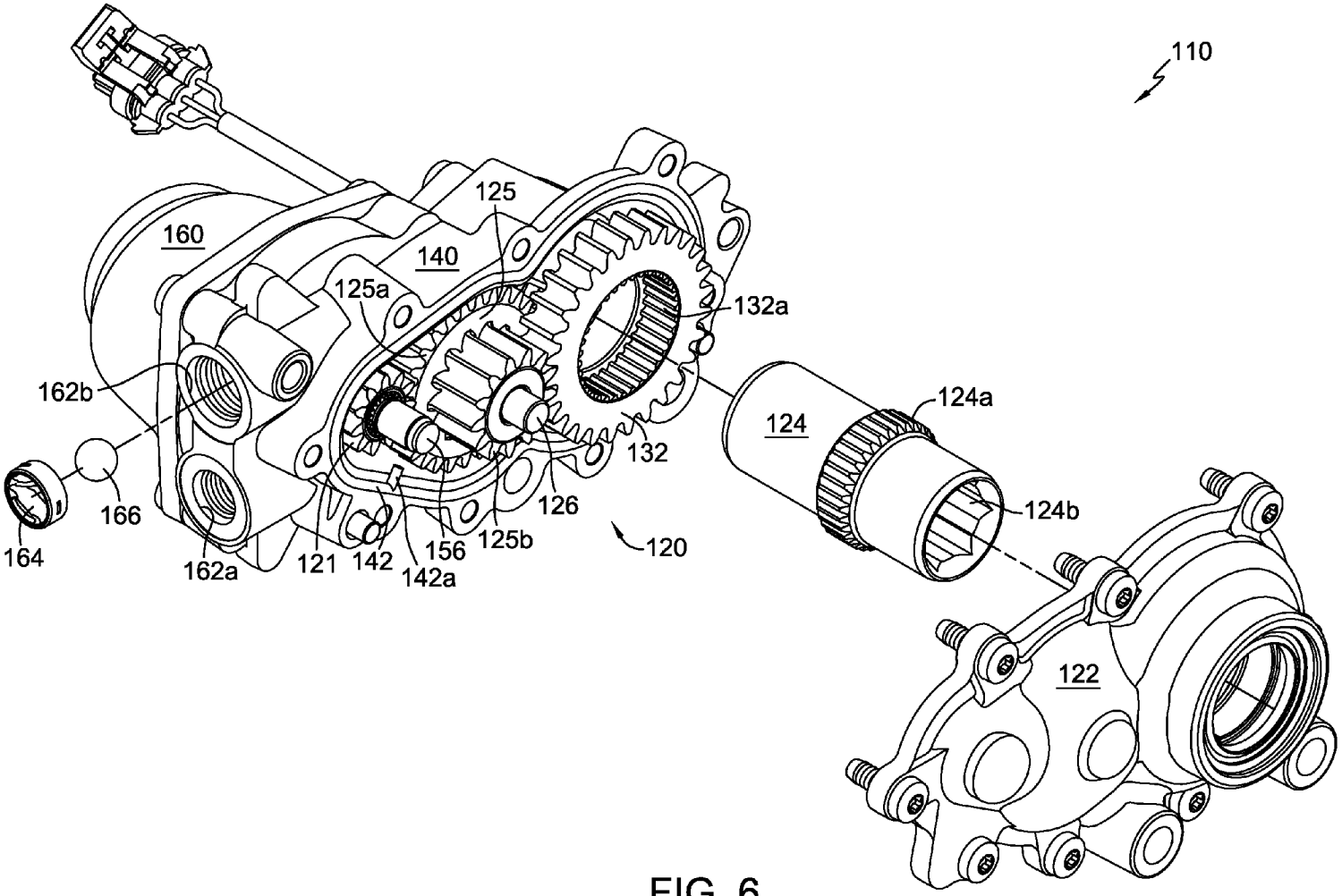
FIG. 6 is another partially exploded perspective view of the hydraulic motor assembly with speed sensor of FIG. 4.
Figure 7:
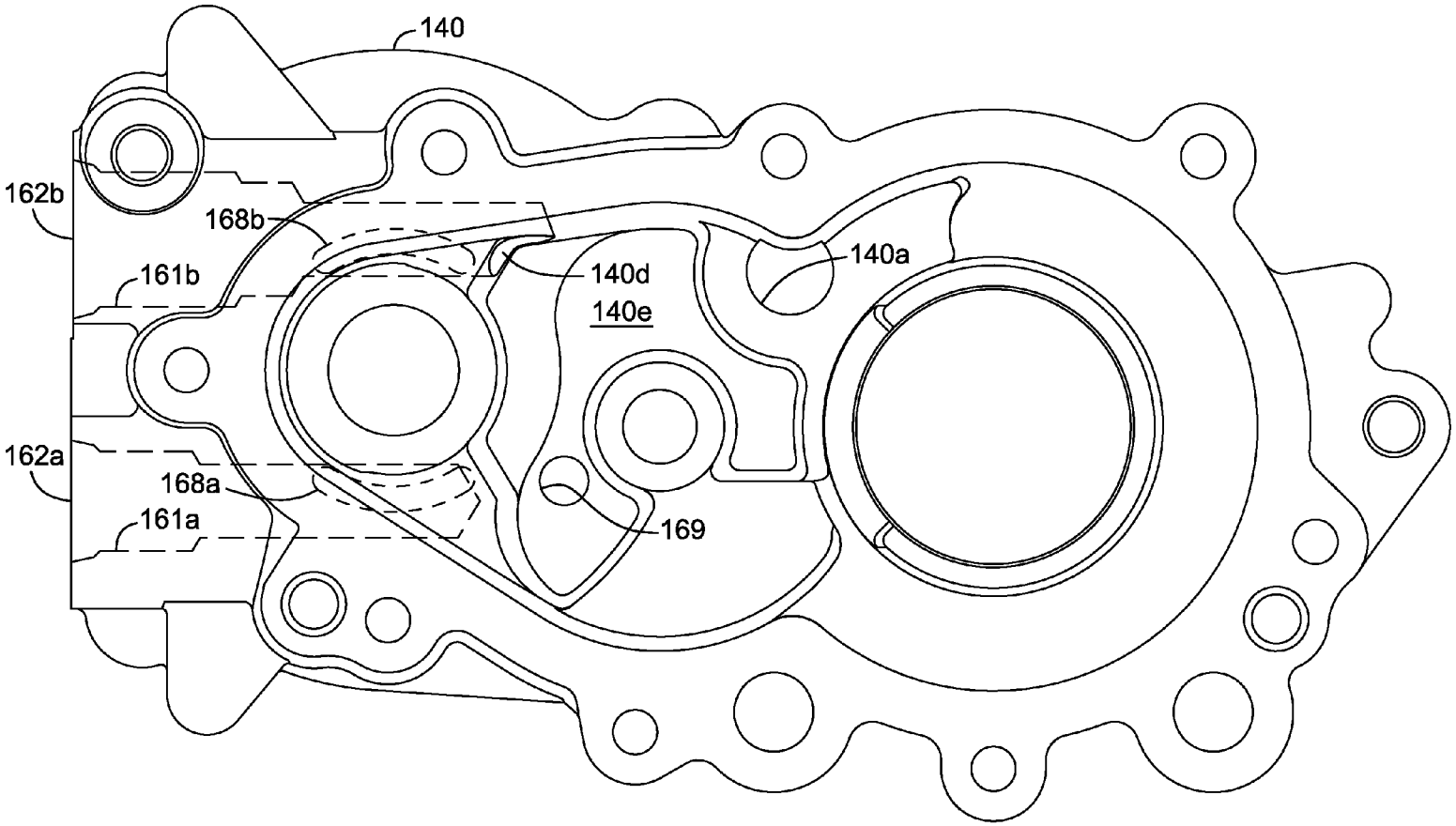
FIG. 7 is an elevational view of a main housing of the hydraulic motor assembly with speed sensor of FIG. 4.

Referring to FIGS. 4-7, a second embodiment of a hydraulic motor assembly 110 of the present invention includes a gear assembly 120 housed within a first volume, namely gear chamber 112, that is formed by joining gear housing 122 and main housing 140. Hydraulic motor assembly 110 also includes a motor 150 housed within a second volume, namely motor chamber 114, that is formed by joining motor housing 160 and main housing 140. Similar to the first embodiment, these two volumes can be hydraulically separate or in fluid communication with one another. In hydraulic motor assembly 110, a fluid passage 169 is provided to connect these two volumes, forming a common sump. Referring to FIGS. 5 and 7, fluid passage 169 is formed in main housing 140, passing through the plane of motor running surface 140*b* while intersecting an adjacent annular groove 140*c* on a first side of main housing 140, and emerging at gear chamber surface 140*e* on the opposite side of main housing 140. The specific location of fluid passage 169 is not critical provided it does not interfere with the operation of hydraulic motor 150 and its porting; for example, fluid passage 169, or a series of passages, could have been located entirely within annular groove 140*c*.

As shown in FIG. 6, the joint between main housing 140 and gear housing 122 can be sealed with a pre-formed, asymmetrical O-ring style seal 142 having an optional alignment nub 142*a* that can serve as a visual positioning indicator or can interface with a mating feature (not shown) formed in either main housing 140 or gear housing 122. This assembly aid is not required and, optionally, a standard O-ring can be installed in an o-ring groove (not shown) formed in either main housing 140 or gear housing 122. Other known sealing means, such as a liquid sealant, may be used to seal the various housing members of hydraulic motor assembly 110. Gear assembly 120, depicted in FIG. 6 as a two-stage reduction assembly, can consist of one or more reduction stages depending on the particular vehicle or apparatus application. The various gears and shafts depicted herein can be supported in the housings in various ways known in the art. The gear assembly 120 initiates with pinion gear 121, which is driven by motor shaft 156.

Pinion gear 121 drives a combination gear 125 that is supported on jackshaft 126. The combination gear 125 includes a gear form 125*a* drivingly engaged with pinion gear 121 and a gear form 125*b* drivingly engaged with concentric drive gear 132. Concentric drive gear 132 drives output shaft 124 via the mating of splines 132*a* and 124*a*. Output shaft 124, which is configured as a through-shaft in hydraulic motor assembly 110, is accessible at each end through corresponding openings in gear housing 122 and main housing 140, and includes a hex mating surface 124*b* which is shaped to engage a correspondingly shaped shaft or axle (not shown). Gear assembly 120, as configured, serves to reduce the output speed of, and increase the torque to, output shaft 124.

Motor 150, depicted herein as an axial piston motor, includes a cylinder block 152 disposed on a running surface 140*b* formed on main housing 140. In this embodiment, main housing 140 includes hydraulic passages 161*a* and 161*b* formed therein that provide fluid communication between the kidney ports 168*a* and 168*b*, respectively, of running surface 140*b* and the hydraulic ports 162*a* and 162*b*, respectively, on the exterior of main housing 140. Hydraulic ports 162*a* and 162*b* in turn provide fluid communication with additional elements of a hydraulic circuit (not shown)

that includes a pump (not shown). Motor shaft 156, supported partially by main housing 140 and partially by gear housing 122, includes splines 156*a* that are mated with splines 152*a* of cylinder block 152. Cylinder block 152 is rotated by hydraulic fluid flow provided by a pump in the hydraulic circuit (not shown) to drive motor shaft 156. Cylinder block 152 receives pistons 154 that ride on thrust bearing 158 and communicate with kidney ports 168*a* and 168*b* that are formed on the motor running surface 140*b*.

For the same reasons as discussed for the first embodiment, an internal case drain is provided for hydraulic motor assembly 110. The presence of hydraulic porting and passages in the main housing, along with the inclusion of fluid passage 169 between motor chamber 114 and gear chamber 112, permit a simple opening 140*d* into hydraulic passage 161*b* to serve as an internal case drain linking gear chamber 112 to hydraulic port 162*b*. Hydraulic port 162*b* necessarily serves as the discharge port for hydraulic motor assembly 110 to insure proper functioning of the internal case drain.

An optional check valve comprising retainer 164 and check ball 166 is installed in hydraulic port 162*b*, and the internal diameter of hydraulic port 162*b* is larger than that of the hydraulic port 162*a* serving as the inlet port.

Speed sensor 170 (e.g., a Hall effect sensor) fits into speed sensor port 140*a* of main housing 140 to sense the rotational speed of an element of the hydraulic motor assembly 110, such as one of the gears or gear forms (e.g. gear form 125*a*) of the gear assembly 120. Similar to the first embodiment, the feedback provided by speed sensor 170 can be transmitted to an electronic controller similar to electronic controller 72 for the hydraulic circuit that regulates the flow of hydraulic fluid from the corresponding pump similar to pump 11; thus permitting precise control of the output of hydraulic motor assembly 110.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention.

The invention claimed is:

1. A drive system, comprising:

a hydraulic pump;

a hydraulic motor assembly in fluid communication with the hydraulic pump through a hydraulic circuit, the hydraulic motor assembly comprising:

a housing, an inlet port formed on an exterior of the housing, a discharge port formed on the exterior of the housing, and a hydraulic mounting surface located in the housing and in fluid communication with the inlet port and with the discharge port via fluid passages, wherein a motor cylinder block is rotatably disposed on the hydraulic mounting surface;

a motor shaft axially engaged to the motor cylinder block and a gear set located in the housing and rotationally engaged to an end of the motor shaft; and an output shaft rotationally engaged to the gear set; and an electronic controller in communication with an electronic actuator engaged to the hydraulic pump and a speed sensor engaged to the hydraulic motor assembly, wherein the speed sensor transmits a signal to the electronic controller indicative of a rotational speed of at least one of the one of the gears in the gear set, and the electronic controller regulates the flow of hydraulic fluid from the hydraulic pump via the electronic actuator based, at least in part on feedback from the speed sensor, to control the speed of the output shaft.

2. The drive system of claim 1, wherein the hydraulic mounting surface is formed integral to the housing.

3. The drive system of claim 1, wherein the output shaft extends from the housing at each of its ends.

4. The drive system of claim 1, wherein the housing comprises a main housing having a first side and a second side opposite to the first side, a motor housing engaged to the first side of the main housing to form a motor chamber, and a gear housing engaged to the second side of the main housing to form a gear chamber.

5. The drive system of claim 4, wherein the motor shaft has a longitudinal axis that is parallel to a longitudinal axis of the output shaft.

6. The drive system of claim 4, further comprising a check valve located in the discharge port and an internal case drain to place the motor chamber in fluid communication with the discharge port.

7. The drive system of claim 6, wherein the discharge port has an inside diameter that is greater than the inside diameter of the inlet port.

8. The drive system of claim 1, wherein the speed sensor is located proximate to the gear set.

9. A drive system, comprising:

a hydraulic motor assembly, comprising:

a common housing assembly having an inlet port and a discharge port formed on an exterior of the common housing assembly to fluidly communicate with a hydraulic pump, the common housing assembly comprising:

a main housing having a first side and a second side opposite to the first side;

a motor housing engaged to the first side of the main housing to define a motor chamber; and a gear housing engaged to the second side of the main housing to define a gear chamber;

a running surface formed in the main housing and having a first port and a second port;

a motor cylinder block located in the motor chamber and rotatably disposed on the running surface;

a motor shaft axially engaged to the motor cylinder block to rotate therewith, wherein the motor shaft has a first end disposed in the motor chamber and a second end disposed in the gear chamber;

a gear set disposed in the gear chamber and rotatably engaged to the motor shaft;

an output shaft rotatably engaged to the gear set; and a speed sensor located in part adjacent to the gear set to measure a rotational speed of one of the gears of the gear set; and a controller in communication with an electronic actuator engaged to the hydraulic pump and the speed sensor, wherein the actuator regulates the flow of hydraulic fluid from the hydraulic pump based at least in part on feedback from the speed sensor.

10. The drive system of claim 9, wherein the inlet port and the discharge port are formed on an exterior of the main housing, a first passage is formed in the main housing to connect the first port to the inlet port and a second passage is formed in the main housing to connect the second port to the discharge port.

11. The drive system of claim 10, wherein the discharge port has an inside diameter that is greater than an inside diameter of the inlet port.

12. The drive system of claim 9, wherein the running surface is integrally formed on a portion of the main housing.

13. The drive system of claim 9, wherein the output shaft is a tubular output shaft.

14. A hydraulic motor assembly comprising:

a housing comprising a main housing having a first side and a second side opposite to the first side, a motor housing engaged to the first side of the main housing to form a motor chamber, and a gear housing engaged to the second side of the main housing to form a gear chamber;

a motor cylinder block disposed in the motor chamber and rotatably disposed on a running surface located in the housing;

hydraulic porting for connecting the motor cylinder block to a hydraulic pump located external to the housing, the hydraulic porting comprising:

a first port and a second port formed on the running surface;

an inlet port formed on an exterior of the housing, and a discharge port formed on the exterior of the housing;

a first passage formed in the main housing to connect the first port to the inlet port and;

a second passage formed in the main housing to connect the second port to the discharge port;

a motor shaft axially engaged to the motor cylinder block to rotate therewith, wherein the motor shaft has a first end disposed in the motor chamber and a second end disposed in the gear chamber;

a gear set disposed in the gear chamber and rotatably engaged to the motor shaft; and an output shaft rotatably engaged to the gear set.

15. The hydraulic motor assembly of claim 14, wherein the motor shaft has a longitudinal axis that is parallel to a longitudinal axis of the output shaft.

16. The hydraulic motor assembly of claim 14, wherein the running surface is formed integral to the main housing.

17. The hydraulic motor assembly of claim 14, further comprising a check valve located in the discharge port and an internal case drain to place the motor chamber in fluid communication with the discharge port.

18. The hydraulic motor assembly of claim 14, wherein the discharge port has an inside diameter that is greater than the inside diameter of the inlet port.

19. The hydraulic motor assembly of claim 14, further comprising a connecting passage from the motor chamber to the gear chamber, wherein the motor chamber and the gear chamber form a common sump.

20. The hydraulic motor assembly of claim 14, further comprising a case drain.

21. The hydraulic motor assembly of claim 14, further comprising a speed sensor having at least a portion thereof located adjacent to the gear set to measure a rotational speed of one of the gears of the gear set.

22. The hydraulic motor assembly of claim 21, wherein the speed sensor is mounted to the exterior of the main housing and passes through the main housing and into the gear chamber.

* * * * *